US005667217A

United States Patent [19]

Kelly et al.

[11] Patent Number: 5,667,217

[45] Date of Patent: Sep. 16, 1997

[54] ROLL-DOWN ARCADE GAME

[75] Inventors: Matthew F. Kelly, San Ramon; Bryan M. Kelly, Almo; Phillip Yee, San Francisco; Kevin A. Heyes, San Jose, all of Calif.

[73] Assignee: RLT Acquisition, Inc., Pleasanton, Calif.

[21] Appl. No.: 520,695

[22] Filed: Aug. 29, 1995

[51] Int. Cl.[6] ..... A63F 7/00

[52] U.S. Cl. ..... 273/126 R; 273/126 A; 273/108; 273/119 R; 273/119 A; 273/123 R; 273/123 A

[58] Field of Search ..... 273/108, 109, 273/110, 113, 116, 118–121, 123, 126, 127 R, 127 B, 127 C, 129 R, 129 V, 129 W

[56] References Cited

U.S. PATENT DOCUMENTS

| | | |
|---|---|---|
| 469,127 | 2/1892 | Cumming . |
| 473,265 | 4/1892 | Reisky . |
| 810,299 | 1/1906 | Pettee . |
| 844,507 | 2/1907 | Falvey . |
| 941,194 | 11/1909 | Hamilton . |
| 1,364,632 | 1/1921 | Harrington . |
| 1,531,783 | 3/1925 | Hampton . |
| 1,543,318 | 6/1925 | Cardoza . |
| 1,563,983 | 12/1925 | Higuchi . |
| 1,652,071 | 12/1927 | Tsujino . |
| 1,879,511 | 9/1932 | Rodgers . |
| 2,087,198 | 7/1937 | Chambers . |
| 2,141,580 | 12/1938 | White . |
| 2,370,050 | 2/1945 | La Rizza . |
| 2,400,261 | 5/1946 | Plebanek . |
| 2,710,756 | 6/1955 | Hooker . |
| 2,736,559 | 2/1956 | Turner . |
| 2,791,428 | 5/1957 | McDonald . |
| 2,926,915 | 3/1960 | Johns . |
| 3,268,227 | 8/1966 | Thatcher, Jr. . |
| 3,275,324 | 9/1966 | Burnside . |
| 3,275,325 | 9/1966 | MacKenzie . |
| 3,429,574 | 2/1969 | Williams . |
| 3,452,987 | 7/1969 | Di Motta . |
| 3,462,149 | 8/1969 | Grusin . |
| 3,476,391 | 11/1969 | Fejko . |
| 3,539,188 | 11/1970 | Salverda . |
| 3,554,553 | 1/1971 | Hayashi . |
| 3,582,074 | 6/1971 | Menotti . |
| 3,584,877 | 6/1971 | Florian . |
| 3,764,143 | 10/1973 | Takahashi . |
| 3,787,055 | 1/1974 | Kraemer . |
| 3,792,548 | 2/1974 | Hamano . |
| 3,807,737 | 4/1974 | Breslow . |
| 3,843,129 | 10/1974 | Dietrich . |
| 3,947,030 | 3/1976 | Goldfarb et al. . |
| 4,023,806 | 5/1977 | Wiser . |
| 4,030,555 | 6/1977 | Boyce et al. . |
| 4,055,344 | 10/1977 | Soucie . |
| 4,173,341 | 11/1979 | Olliges . |
| 4,212,465 | 7/1980 | Arad . |
| 4,215,867 | 8/1980 | Natwick . |
| 4,216,961 | 8/1980 | McQuillan . |
| 4,216,963 | 8/1980 | Boucher . |
| 4,240,635 | 12/1980 | Brown . |
| 4,257,600 | 3/1981 | Goldfarb . |

(List continued on next page.)

*Primary Examiner*—Raleigh W. Chiu
*Attorney, Agent, or Firm*—Hickman Beyer & Weaver

[57] ABSTRACT

An arcade game including an inclined playing surface and a coin directing mechanism. A coin hopper forces multiple coins through the coin directing mechanism and onto the playing surface for each activation of a button by the player. The player can direct the multiple coins in a desired direction down the playing surface using the directing mechanism. The coins roll toward one or more targets on the playing surface, and a game score is adjusted based on the targets that receive the coins. Indicators for the targets can highlight specific targets and goals during game play. A progressive bonus score can also be added to the game score when a progressive goal is achieved by the player. After the game is over, a tilting mechanism tilts the playing surface to clear the playing surface of coins that have not rolled into apertures and are resting on the playing surface.

49 Claims, 9 Drawing Sheets

U.S. PATENT DOCUMENTS 4,260,153 4/1981 Nishimiya .
4,261,577 4/1981 Ellis .
4,303,248 12/1981 Shoemaker, Jr. et al. .
4,311,311 1/1982 Crosman .
4,332,385 6/1982 McCaslin .
4,397,463 8/1983 Moscovich .
4,496,160 1/1985 Wichinsky et al. .
4,569,522 2/1986 Davies .
4,650,190 3/1987 Geiger .
4,662,846 5/1987 Quercetti .
4,743,024 5/1988 Helm et al. .
4,759,551 7/1988 Crompton .
4,837,728 6/1989 Barrie et al. .
4,893,821 1/1990 deOrbegoso et al. .
4,948,133 8/1990 Helm et al. .
4,964,638 10/1990 Ishida .
5,002,279 3/1991 Kaminkow et al. .
5,014,988 5/1991 Mirando et al. .
5,016,880 5/1991 Berge .
5,042,813 8/1991 Huang .
5,048,832 9/1991 Kaminkow .
5,048,833 9/1991 Lamle .
5,064,196 11/1991 Gottlieb .
5,066,014 11/1991 Dobson .
5,071,127 12/1991 Bromley et al. .
5,096,192 3/1992 Stanford, Jr. .
5,104,129 4/1992 Hämäläinen et al. .
5,110,128 5/1992 Robbins .
5,131,655 7/1992 Ugawa ..... 273/123 A X
5,137,278 8/1992 Schilling et al. .
5,149,093 9/1992 Schilling et al. .
5,161,801 11/1992 Kazuk .
5,181,722 1/1993 Krutsch et al. .
5,184,821 2/1993 Korenek .
5,249,800 10/1993 Hilgendorf et al. .
5,255,916 10/1993 Bleich .
5,280,909 1/1994 Tracy .
5,286,023 2/1994 Wood .
5,292,127 3/1994 Kelly et al. ..... 273/123 A X
5,318,298 6/1994 Kelly et al. .
5,326,108 7/1994 Faith .
5,368,300 11/1994 Becker ..... 273/119 X
5,385,347 1/1995 Halliburton .
5,409,225 4/1995 Kelly et al. ..... 273/123 A X
5,425,536 6/1995 Kelly et al. .
5,445,376 8/1995 Bromley ..... 273/113 X Fig. 3a
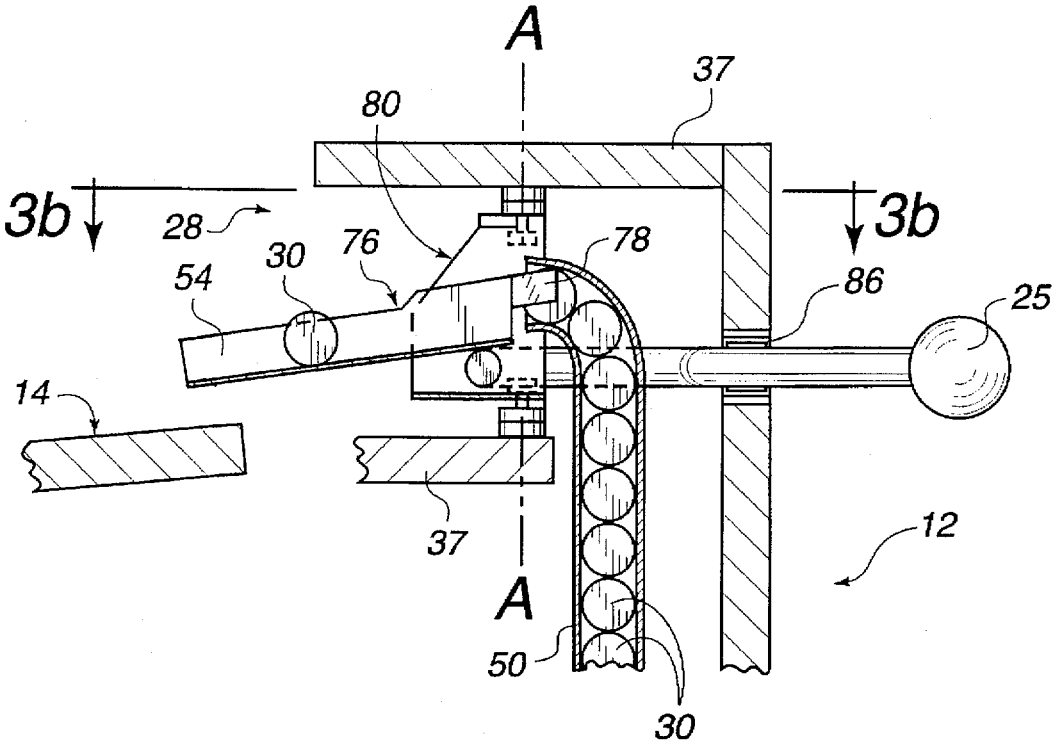
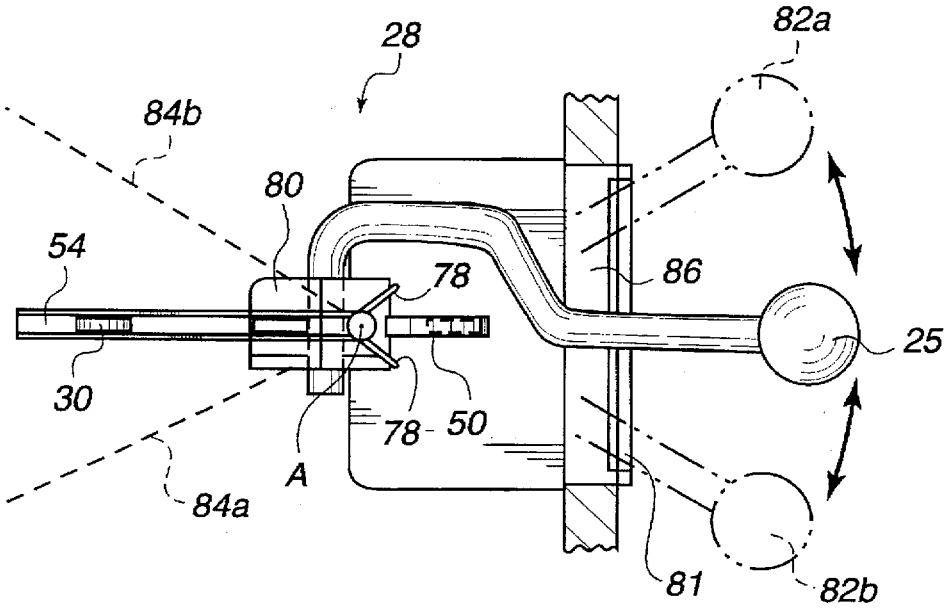
Fig. 3b Fig. 4a
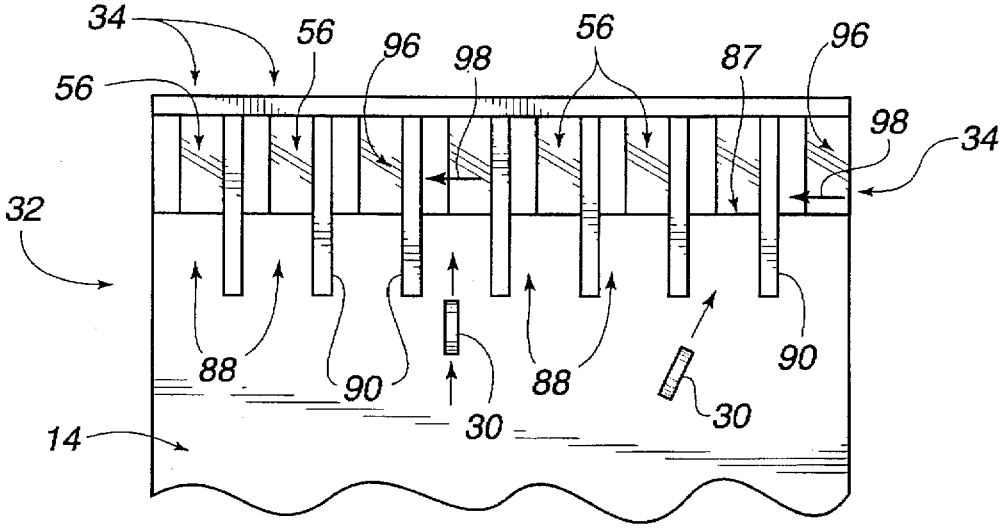
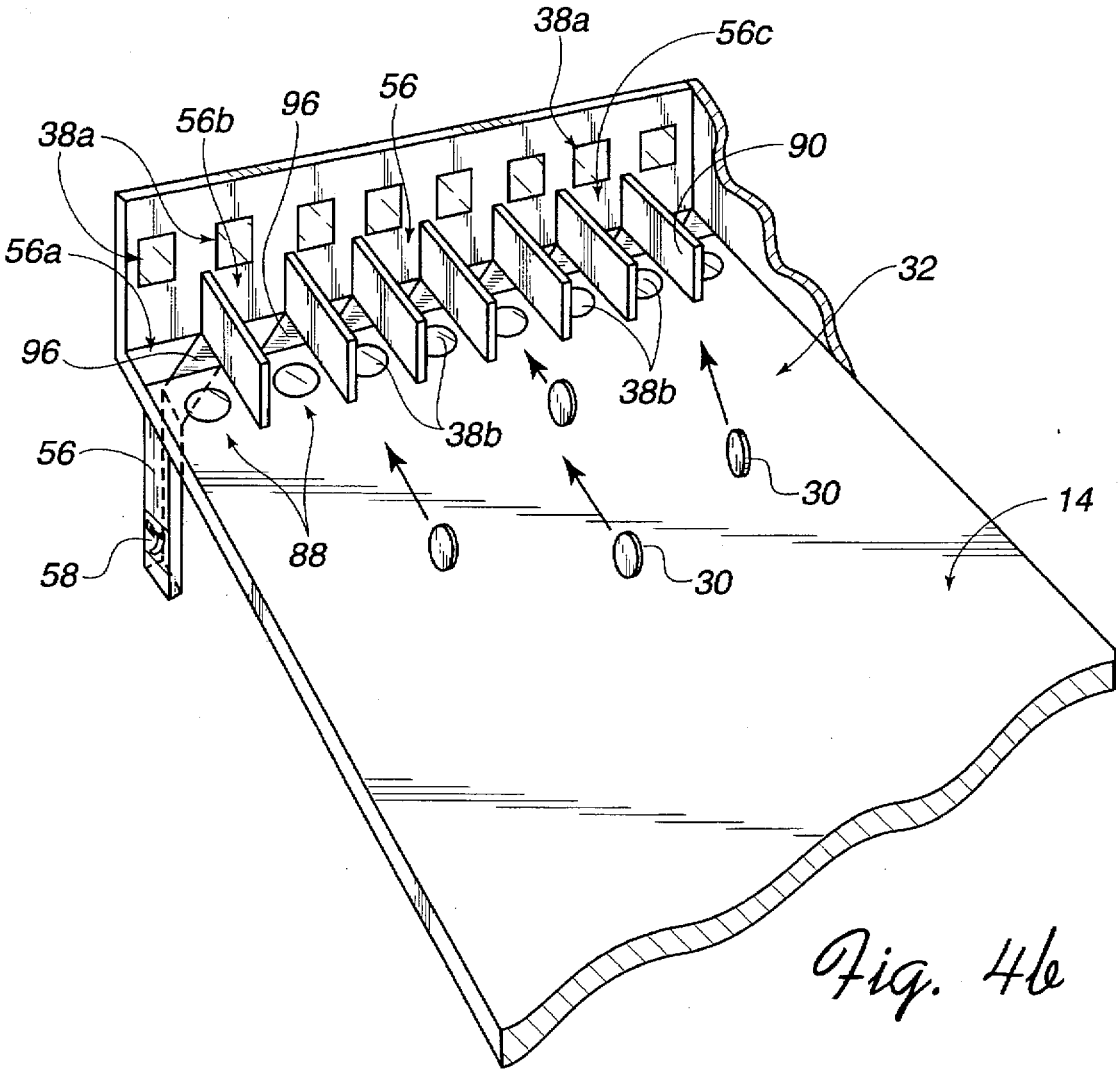
Fig. 4b

ROLL-DOWN ARCADE GAME

BACKGROUND OF THE INVENTION

1. Field of the Invention

This invention relates to games normally played in an arcade environment, and more particularly to such games played by directing a playing piece across a playing surface.

2. Background of the Related Art

Games of many types are played in arcade environments. Roll-down games are popular types of arcade games that utilize a ramp and a playing piece, such as a coin, that is directed down the ramp. A player can direct the coin onto or into targets or around obstacles, and a game score is accumulated based upon the player's success.

For example, U.S. Pat. No. 4,759,551, by Crompton, describes a game in which a player inserts a coin and activates a trigger on a coin gun to release a rolling coin onto a moving belt of targets. A player may activate the trigger multiple times to release multiple coins for each inserted coin.

U.S. Pat. No. 5,071,127, by Bromley et al., describes a coin bowling game in which a player directs the path of an inserted coin to roll on a playing field toward target pins. The coin is directed by a pivoting coin chute.

U.S. Pat. No. 4,261,577, by Ellis, describes a game in which players on opposing sides of a playing field each propels a washer onto the playing field and into various apertures and obstacles. Each player uses a spring load ejector mechanism to propel the washers.

U.S. Pat. No. 4,303,248, by Shoemaker, Jr. et al., describes a game in which players can each use a pivotable coin shute to direct coins onto a surface having accumulated coins. A vertical dam translates over the surface to drop certain coins over the edge for a player score. Games of the prior art, while enjoyable, tend to be simplistic and, as such, can lead to rapid player boredom. For example, the games of the prior art all provide one coin for the player to direct at a time, which can lead to repetitive, monotonous game action. This is undesirable in an arcade environment where revenues are directly related to the continuous, repeated use of the games.

SUMMARY OF INVENTION

The present invention provides an arcade game having a playing surface and a guiding mechanism which releases multiple playing pieces in rapid succession (or at once) onto the playing surface. The playing pieces roll toward targets positioned at one end of the playing surface. The player guides multiple coins in rapid succession toward provided targets which can be highlighted before and during play. These improvements add excitement and complexity to the game, which tends to prolong player involvement.

A game apparatus of the present invention includes a playing surface and a playing piece guiding mechanism positioned at a player end of the playing surface. The guiding mechanism directs playing pieces down the playing surface in a desired direction. An activation control can be activated by a player to release a plurality of playing pieces onto the playing surface. One or more targets positioned at a target end of the playing surface receive at least one of the released playing pieces.

The playing pieces are preferably coins, and the playing surface is inclined to allow the coins to roll down the playing surface on the edges of the coins. The player inserts a coin into a coin slot to begin a game. A coin hopper or other playing piece moving mechanism dispenses coins from a collection bin and moves the coins through the guiding mechanism, which can be pivoted by the player to direct the playing pieces in a desired direction. The number of coins released after activation can vary according to the embodiment. The coins roll into the targets, which are preferably slots with guide walls and include apertures at the end of the slots into which a playing piece may fall. A sensor is positioned in each aperture to detect a coin's passage in the aperture. The coins fall through the apertures to a ramp and are guided into the collection bin of the coin hopper.

The target apertures preferably include illuminated indicators to highlight specific apertures. Apertures can be highlighted before the coins are released so as to designate specific apertures that will modify a game score. A progressive goal can also be indicated by highlighting specific apertures, so that if the player guides coins into the highlighted apertures, a progressive bonus score is added to the game score. The progressive bonus score can be accumulated over multiple games on the game apparatus. The apertures that receive coins can also be highlighted. An award dispenser preferably dispenses an award based upon the final game score. In addition, once the game is over, a tilting mechanism preferably tilts the playing surface to clear the playing surface of coins that have not rolled into apertures and are resting on the playing surface.

A method for playing a roll-down game apparatus of the present invention includes steps of determining when an activation control has been activated and, when such a control has been activated, dispensing multiple playing pieces, such as coins, onto a playing surface. The coins roll down the playing surface toward multiple provided targets. The targets receive the coins, and a game score is provided based on the receiving targets. A guiding mechanism allows a player to guide the coins toward the targets, which include apertures that receive the coins. Designated targets can be highlighted after coins are received by the targets and/or before the coins are released. A desired pattern of targets can be highlighted so that the player receives a game score only if the highlighted targets receive a playing piece. The game score is determined based on point scores associated with apertures that receive the coins. A progressive score can also be added to the game score when the player achieves a progressive goal. An award can be dispensed to a player based upon the game score. The playing surface is tilted at the end of the game to clear coins resting on the playing surface that have not been received by targets.

The game apparatus according to the present invention releases multiple playing pieces onto a playing surface in quick succession after one player activation and allows the player to guide the playing pieces as skillfully as possible toward targets. The targets can be highlighted to designate player goals during game play. These: features add complexity and interest to an otherwise simple roll-down game. Player involvement with the game and the revenue produced by the game are thus also increased.

These and other advantages of the present invention will become apparent to those skilled in the art after reading the following descriptions and studying the various figures of the drawings.

BRIEF DESCRIPTION OF THE DRAWINGS

FIG. 3*a* is a detailed side view of the guiding mechanism of the present invention;

FIG. 3*b* is a detailed top plan view of the guiding mechanism of FIG. 3*a;*

FIG. 4*a* is a top plan view of a portion of the targets and playing surface of the game apparatus;

FIG. 4*b* is a perspective view of the target end of the playing surface of FIG. 4*a;*

DETAILED DESCRIPTION OF THE PREFERRED EMBODIMENTS

Figure 1:
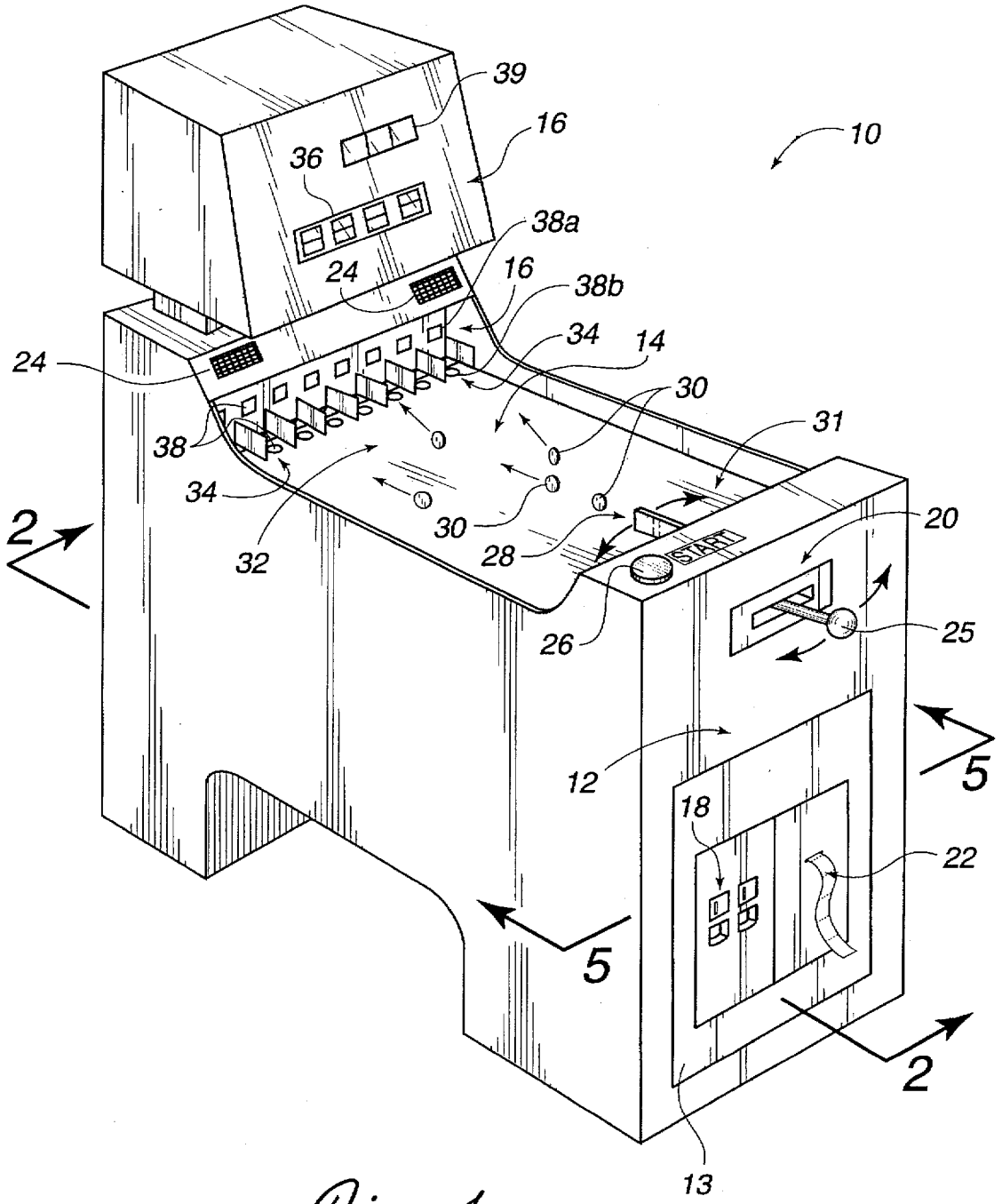
FIG. 1 is a perspective view of a preferred embodiment of the game apparatus of the present invention.

FIG. 1 is a perspective view of a game apparatus in accordance with the present invention. The game apparatus 10 includes a front panel section 12, a playing surface 14, and a display section 16.

Figure 2:
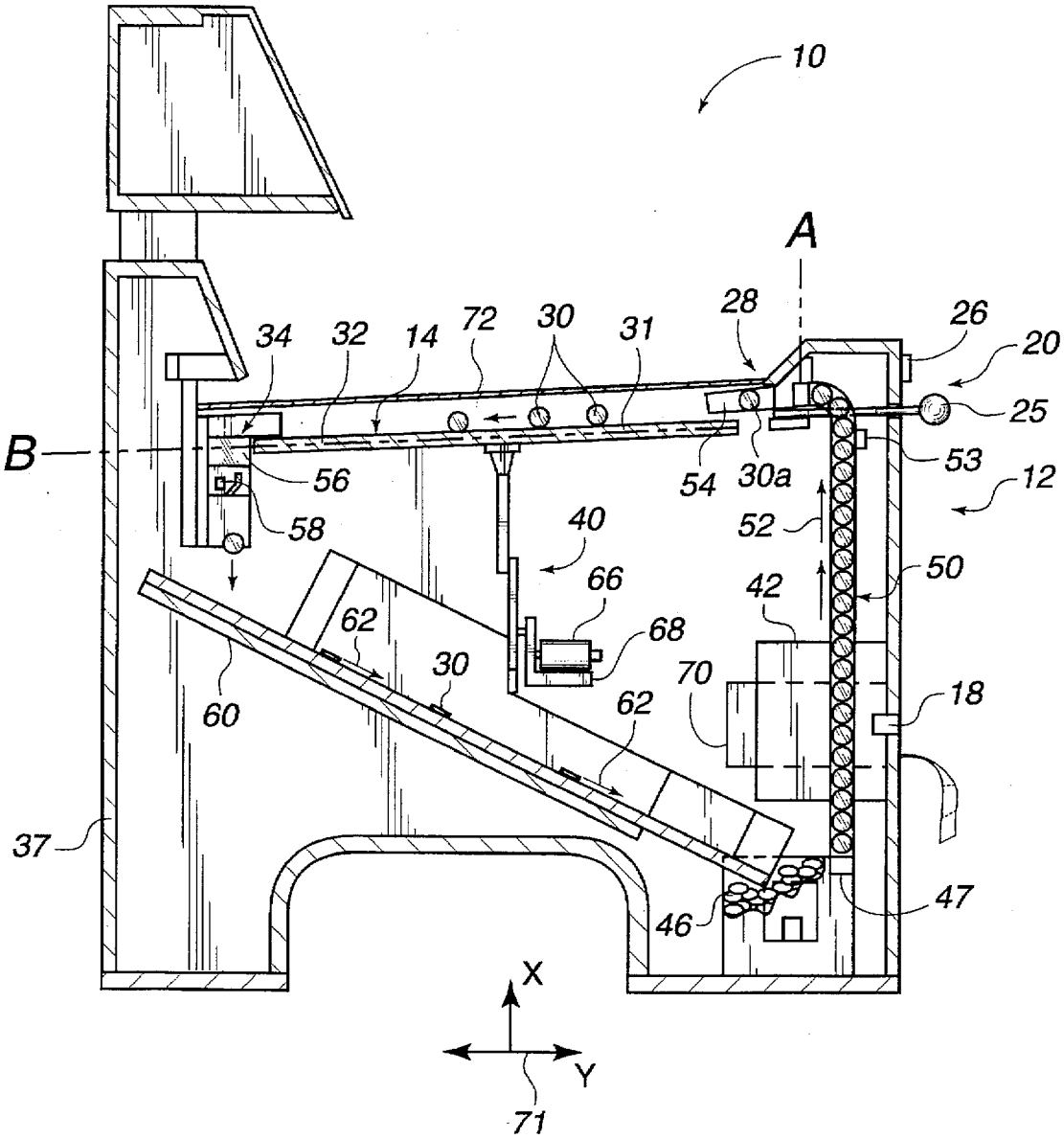
FIG. 2 is a side cross-sectional view of the game apparatus taken along line 2—2 of FIG. 1.

The front panel section includes a coin deposit slot 18, player controls 20, a ticket dispenser 22, and a speaker 24. The front panel section preferably also includes an access door 13, which can be opened by the operator to access the interior components of the game apparatus as shown in FIG. 2.

Coin deposit slot 18 may accept standard currency coins, game tokens that are often available in an arcade environment, or any other monetary input (e.g. dollar bills, debit card, etc.). A game begins after a coin or token has been inserted by the player. The inserted coin is preferably routed to a cash box, as explained subsequently. A coin return slot is typically also included to return an inserted coin or token to the player in the event the coin becomes trapped in the coin slot mechanism, etc. The player can activate a return button that is well known in the art.

Player controls 20 preferably include an aiming control 25 and an activation control 26. Aiming control 25 is preferably a rod, joystick, gun handle, or similar object that includes a grip for the player to grasp. Aiming control 25 can preferably pivot right or left to correspondingly pivot a coin directing mechanism 28 to which it is attached, as described in greater detail with respect to FIGS. 2, 3*a*, and 3*b*. In alternate embodiments of the present invention, different control mechanisms can be employed. For example, aiming control 25 can be coupled to electrical motors and other components which pivot or otherwise move the coin directing mechanism 28. In other embodiments, buttons can be used to move the coin directing mechanism using motors and similar components well known in the art. Activation control 26 is preferably a button, trigger, switch, or similar device which releases coins when pressed by the player. Activation control 26 can be provided above or on front panel 12, as shown in FIG. 1; or, the control 26 can be provided on aiming control 25 as a joystick button, gun trigger, etc. After activation control 26 has been pressed, coins are provided on the playing surface and roll down the playing field 14, as described subsequently. In an alternate embodiment, activation control 26 is not provided, and a game starts as soon as a player inserts a coin in coin slot 18.

Ticket dispenser 22 preferably dispenses a ticket award to the player based upon a game score. In this present embodiment, tickets may be accumulated to win various prizes. Other types of awards besides tickets can also be dispensed. For example, baseball or other sports cards can be dispensed, or even coins or currency. Ticket dispensing mechanisms are well-known in the prior art. The awards are stored in a storage area behind the front panel 12 which is described in more detail with reference to FIG. 2.

Speakers 24 emit sounds based on game actions and other game states and is controlled by the game control system. The operation of the speaker will be discussed in greater detail subsequently. Various other types of buttons, switches, and the like can also be included to allow the player of the game to make various selections concerning game play. For example, a player could select a one- or two-player game, a preferred award type, a progressive option, etc. using additional controls on front panel 12.

Playing surface 14 includes a player end 31 and a target end 32. In the preferred embodiment, playing surface 14 is a substantially planar ramp that is inclined from a horizontal axis such that target end 32 is lower than player end 31. In the described embodiment, playing surface 14 is not inclined more than a few degrees. In other embodiments, more inclination can be added; for example, as in Pachenko-style games, an almost vertical inclination of playing surface 14 can be provided. Player end 31 is positioned below a coin directing mechanism 28 which introduces and guides playing pieces onto the playing surface 14.

In the described embodiment, the playing pieces are coins 30 that travel down the playing surface 14 from the player end 31 to the target end 32 (described in detail subsequently). As referenced herein, the term "coin" refers to any type of round coin, token, or similar object. In other embodiments, different types of playing pieces can be used, such as spherical balls, cylinders, discs, etc. For example, small ball bearings ("BB's") can be released onto the playing surface similar to the coins in the present invention.

The playing surface 14 is preferably a smooth surface to allow the coins to roll; but it can also be a rough, textured, channeled, or contoured surface that may not allow such rolling.

Thus, the term "roll" or "roll-down" may also include other types of playing piece travel, such as sliding or bounding. Also, in other embodiments, playing surface 14 can include obstacles to impede or influence the path of playing pieces that travels across the playing surface, such as apertures, pegs, or other objects.

The target end 32, in the preferred embodiment, includes one or more targets 34 that are operative to receive or engage the coins 30. In the preferred embodiment, targets 34 include slots surrounded by guide walls that direct a playing piece to apertures into which coins 30 may fall. The slots and apertures are described in more detail with reference to FIGS. 4*a* and 4*b*. In other embodiments, other types of targets can be provided, such as stops, switches, gates, bumpers, sensors, and other types of targets well known to those skilled in the art of pinball and similar games.

Display section 16 includes a game score display 36, an optional progressive display 39, and coin detection indicators 38. The game score display 36 is preferably an LED display that indicates a game score to the player based on the results of a game. Game score is described with reference to FIGS. 4*a* and 4*b*. In other embodiments, score display 36 can be positioned in other areas of game apparatus 10, such as on front panel 12. Other types of types of displays can also be used, such as LCD, etc.

Optional progressive score display 39 can be included in display section 16. Progressive display 39 is similar to game score display 36, except that a current progressive score, separate from the game score, is displayed. The progressive score is accumulated from the current and previous games and is added to the game score if a progressive goal is achieved during a game; progressive goals are described subsequently. The progressive score displayed by progressive display 39 is added to the player's game score on display 36. The progressive score, for example, cab be incremented with every coin inserted in coin slot 18, automatically incremented over time at regular intervals, manually incremented by an operator, etc. In another embodiment, multiple game apparatuses can all be linked to a separate progressive bonus apparatus. Each individual game apparatus contributes to a collective progressive score that is stored and displayed by the bonus apparatus (the display 39 of individual game apparatus 10 can alternatively display a collective progressive bonus). The collective progressive score can be awarded to the first player of a linked game apparatus to achieve a progressive goal. Progressive goals, scores, and bonus apparatuses are described in greater detail in U.S. Pat. No. 5,292,127, by Kelly et al., entitled "Arcade Game", which is hereby incorporated by reference herein. Additional score displays can also be used to provide scores for multiple players of game apparatus 10 or provide other functions during game play.

Display area 16 also includes indicators 38. Each indicator 38 is preferably positioned near an associated target 34, which in the described embodiment includes a slot and aperture. The indicators can "highlight", i.e. visually designate, particular apertures to preferably provide visual feedback to a player concerning which target received a playing piece. The indicators 38 can also be used to direct the attention of the player to a particular target 34 before the targets have received playing pieces. For example, in the preferred embodiment, indicators 38*a* are lights positioned above each target 34. Indicators 38*b* can be positioned on playing surface 14 to illuminate a particular target slot. The operation of indicators 38 is described in greater detail with reference to FIG. 4*b*.

The game score display, player control, coin detection, award dispensing, and other functions of the game apparatus are preferably controlled by a control system. This system is described in detail with respect to FIG. 7.

FIG. 2 is a cross-sectional view of the game apparatus 10 taken along line 2—2 of FIG. 1. Game cabinet 37 supports the playing surface 14 and front panel 12 and includes a number of interior components. Playing surface 14 is supported by hinges coupled to one side of game cabinet 37 and is also supported by a tilting mechanism 40 so that the playing surface is able to tilt down. This is described in greater detail with respect to FIG. 5.

A player deposits a coin into coin slot 18 in front panel 12. The inserted coin is routed to a cash box 42 which stores accumulated coins that players have deposited. The coins in cash box 42 are preferably kept separate from any of the coins or other playing pieces used during a game of the present invention. The operator of game apparatus 10 can periodically empty cash box 42 when it becomes full. Alternatively, the coin inserted by the player in coin slot 18 can be routed to the collection bin 46 of coin hopper 44 of the present invention and eventually circulates as a playing piece during the current game or a subsequent game.

In yet another embodiment, a player may insert a number (preferably more than one) of coins in coin slot 18 and those inserted coins will become the playing pieces in the game (all coins preferably being released with one activation as described below). The inserted coins could be loaded into a chamber and then released onto the playing surface when the activation control was activated (a coin hopper (described below) would thus not be required in this embodiment). In such an embodiment, the player's chances of scoring in the game can be influenced by the number of coins inserted by the player. For example, the more coins inserted, the more coins are moving towards the targets 34, and thus the greater the chance that coins will fall into targets and/or a specific target is hit. Or, alternatively, a number of other types of playing pieces, such as discs or balls, based on the number of inserted coins can be released.

Referring back to the described embodiment of FIG. 2, after a coin has been inserted by a player, the player may preferably activate activation control 26, which can be a button or other device, or, for example, a sensor which detects a player's motion, sound, etc. In an alternate embodiment, activation control 26 is not provided as a control for the player, but is instead activated by the control system (shown in FIG. 7) or other component of the game apparatus 10. For example, after a player inserts a coin in coin slot 18, the game apparatus can display or voice on speakers a timed countdown as to when playing pieces will be automatically released. When the countdown is over, the control system of the game apparatus can activate coin hopper 44 (detailed below) to release coins onto the playing surface 14.

Activation control 26 is operative to activate coin hopper 44 using the control system for game apparatus 10, as described below with respect to FIG. 7. Coin hopper 44 is preferably positioned near the bottom of game apparatus 10 so as to receive coins 30 that have been used during a game and to provide more coins to be used in the current game. When the player activates activation control 26, coin hopper 44 begins collecting coins from a collection bin 46 of the coin hopper and dispenses the coins out of an outlet 47. Coin hoppers such as hopper 44 are well known to those skilled in the art. For example, coin hopper model CH-500/U1 or model DH-750/U1 from Asashi Seiko of Las Vegas, Nev. is suitable for the present invention. Such coin hoppers may also include escalator sleeves (discussed below). Other types of coin hoppers or coin-moving mechanisms can also be used for the present invention.

Coins dispensed out of coin hopper 44 enter a thin escalator sleeve 50 that is preferably positioned vertically and is coupled to outlet 47 of coin hopper 44 at one end. Inside sleeve 50 is a column of mutually touching, edge-to-edge coins 30 that is stacked up to the coin directing mechanism 28, which is coupled to the other end of sleeve 50. When a coin is forced out of outlet 47 by coin hopper 44, the column of coins in sleeve 50 is also forced upward, as indicated by arrow 52. This, in turn, causes a coin 30*a* at the front of the column of coins to be forced through coin directing mechanism 28. As the coins move upward, a sensor 53 senses the passage of each coin and sends this information to the control system. Sensor 53 is preferably an optical slotted switch that includes an emitter and detector positioned on each side of a passing coin such that when a beam of electromagnetic energy from the emitter, such as infrared light, is blocked by a passing coin, the detector senses that the beam is blocked. These types of sensors are well known to those skilled in the art. Alternatively, sensor 53 can be a different type of sensor, such as a Hall effect sensor.

Coin directing mechanism 28 allows a front most coin 30*a* to roll through a guide 54 positioned at the front of the coin directing mechanism. Using aiming control 25, a player can move guide 28 so as to direct coin 30*a* in a desired direction or location on playing surface 14. Coin directing mechanism is described in greater detail with respect to FIG. 3*a*. The front most coin 30*a* falls, rolls, is ejected, or otherwise moves onto playing surface 14 (i.e. the playing piece is "released" onto the playing surface from mechanism 28) and rolls down the playing surface 14 towards target end 32 due to the force imparted on the coin from coin hopper 44 and also due to gravity. The coin rolls on its edge due to guide 54 being thin and directing the coin to roll on its edge through the coin directing mechanism 28. Alternatively, additional mechanisms can be used to provide additional force on coin 30*a* so that the coin moves more quickly down playing surface 14.

In the present invention, multiple coins 30 (or other types of playing pieces) are released onto playing surface 14 from coin directing mechanism 28 each time a player (or control system) activates activation control 26 (i.e., an "activation"). The number of coins 30 that is released for one activation can be predetermined as a fixed number that is at least one (preferably at least two) and can be as high as the operator desires. For example, five coins can be released for each activation. In an alternate embodiment, multiple activations can be provided to a player for each coin inserted in coin slot 18, and the number of coins released can vary for each activation. The varying number of released coins can be determined randomly, or according to a pattern. For example, the number of released coins for each activation can increase (or decrease) according to an arithmetic or geometry series (1 coin, 2 coins, 4 coins, etc.). In yet another embodiment, the number of coins released in one activation can depend on the number of coins inserted by the player in coin slot 18; for example, 5 coins can be released per activation if 1 coin is entered in coin slot 18, while 9 coins can be released per activation if 2 coins are inserted.

To release multiple coins with one activation, coin hopper 44 is controlled to continually dispense coins from outlet 47. When the desired number of coins have been detected by sensor 53, the coin hopper is deactivated. For example, if five coins are to the released, the coin hopper is activated to dispense coins, one coin at a time, until five coins have been sensed by sensor 53. This causes five coins 30 to roll through coin directing mechanism 28 and onto playing surface 14 in rapid succession. The coins typically follow each other in a line as they are released onto the playing surface 14. In an alternate embodiment, a coin directing mechanism can be employed to release multiple coins simultaneously onto the playing surface rather than in succession. For example, a mechanism having , five adjacent guides 54 can be used to release five coins simultaneously.

In alternate embodiments where playing pieces other than coins 30 are used, a different mechanism can be provided to move the playing pieces from the bottom of the game apparatus 10 to a playing piece directing mechanism. For example, a hopper can be used for balls to force the bails through a chute and onto playing surface 14, similar to the mechanism described.

Once released onto the playing surface, the released coins 30 roll toward targets 34. Small (or desired) variations in coin directing mechanism 28, playing surface 14, and the coins 30 themselves typically cause the coins to follow different paths down playing surface 14, even if a player does not pivot the coin directing mechanism 28. If a player pivots coin directing mechanism 28 to actively guide the coins, this naturally greatly increases the variation of the paths of the different coins.

At target end 32 of playing surface 34, the coins 30 are received by targets 34. In the described embodiments, a number of slots are provided to receive the coins and guide them to an aperture 56 associated with each slot. The slots and apertures are described in greater detail with reference to FIGS. 4*a* and 4*b*. The coins 30 fall through the apertures and are sensed by sensors 58 positioned in apertures 56, where each aperture includes a corresponding sensor 58. In the described embodiment, sensor 58 is a switch that is activated by a coin falling through a sleeve, as is well known to those skilled in the art. Alternatively, other types of sensors can be used; for example, an electromagnetic sensor, as described above, can be positioned in aperture 56. Alternatively, a Hall effect switch can be used, which can sense metallic materials (as used in a coin) using a magnetic apparatus.

Coins 30 fall from apertures 56 preferably to a collection ramp 60 positioned underneath playing surface 14 and apertures 56. The coins slide or roll down the collection ramp, as indicated by arrows 62, until they reach collection bin 46 of coin hopper 44. The coin hopper 44 thus continually dispenses and collects coins 30 as games are played.

In an alternative embodiment, space or collectors can be provided around the outside of playing surface 14 to collect coins that may fall off a side of the playing surface. For example, coins can fall off a side edge onto the collection ramp 60 below, or fall into side gutters running parallel to the length of the playing surface 14.

Some coins 30 released through coin directing mechanism 28 do not fall into apertures 56. A coin may occasionally drop onto playing surface 14 from mechanism 28 in a tilted position, and thus fail to roll on its edge. Or, a coin may impact an obstacle situated on playing surface 14 and fall on its side. Such coins may come to rest on playing surface 14 and potentially block other coins from rolling into apertures 56. To prevent such an occurrence, playing surface 14 can preferably be tilted such that one edge of the playing surface 14 is rotated about an axis down toward the bottom of game apparatus 10. This movement is shown in greater detail with respect to FIG. 5. Any stray coins 30 which have come to rest on the playing surface are thus forced to move off the playing surface and fall onto collection ramp 60. The coins then move down ramp 60 into collection bin 46 of coin hopper 44.

Tilting mechanism 40 is used to control the tilting movement of playing surface 14. A motor 66 preferably rests on a platform 68 attached to game cabinet 37. Motor 66 is operative to lower tilting mechanism 40 and playing surface 14, as is described in greater detail with respect to FIG. 5. Preferably, the tilting mechanism 40 is attached to playing surface 14 near the center of the playing surface in the dimension defined by y-axis 71.

Award dispenser box 70 is positioned close to front panel 12. Awards dispensed by the dispenser 22 are preferably stored in the box 70. Game apparatus 10 also preferably includes protective glass 72 which prevents the player from interfering with game play.

The game apparatus 10 of the present invention preferably releases multiple coins onto the playing surface after a single activation of activation control 26 by the player. This added complexity can provide more enjoyment for players, since the player can employ greater skill in operating guiding mechanism 28 to direct several coins into desired apertures. In addition, the game apparatus 10 allows a player to direct multiple playing pieces in a game for each coin inserted in coin slot 18, which is more satisfying than those games of the prior art which allow only an inserted coin to be used as a single playing piece during a game.

In an alternate embodiment, non-standard coins designed specifically for use with the game apparatus 10 can be used as playing pieces. Since inserted coins are routed to a separate cash box 42 instead of being used as a playing piece in the game, standard coins or tokens do not have to be used as playing pieces. Thus, for example, coins with a thicker edge can be used to allow the playing pieces to roll more easily on playing surface 14.

FIG. 3*a* is a detailed side view of coin directing mechanism 28. Coins 30 are pushed up through sleeve 50 by coin hopper 44. One or more coins at the front of the column of coins then rolls onto guide member 76, which includes angled rear tabs 78 to prevent any coins from falling outside the guide member. Guide member 76 also includes guide 54, which is only slightly wider than a coin 30 so that a coin is guided along the coin's edge. Guide 54 projects over playing surface 14 so that a coin will fall from the guide onto the playing surface and continue rolling on its edge down playing surface 14.

Guide member 76 is coupled to hinge member 80, which can be rotated about axis A to direct a coin in a desired direction, as more dearly shown in FIG. 3*b*. Hinges 82 couple hinge member 80 to the game cabinet 37. Aiming control 25 extends through aperture 86 in game cabinet 37 and is coupled at one end to hinge member 80. Control 25 can be moved by a player to pivot coin directing mechanism 28.

FIG. 3*b* is a top plan view of the coin directing mechanism shown in FIG. 3*a*. Sleeve 50 holding the column of coins is shown having a width only slightly greater than a width of a coin 30. Guide 54 similarly has a narrow width to guide a coin 30 on the coin's edge. Aiming control 25 preferably curves around sleeve 50 and is coupled to hinge member 80 from a side.

Dashed positions 82 of aiming control 25 show the various positions that the player can move the aiming control. When aiming control 25 is rotated to position 82*a*, the coin 30 will be directed generally in the direction of dashed line 84*a*. Likewise, when aiming control 25 is moved to position 82*b*, the coin 30 will be directed generally in the direction of dashed line 84*b*. Preferably, a sliding plastic sleeving 81 is included to move with control 25 and cover the gap 86 when control 25 is moved to one side.

In alternate embodiments, other coin directing mechanisms can be used. For example, a mechanism that translates along the edge of player end 31 of playing surface 14 can be used instead of a pivoting mechanism.

FIG. 4*a* is a top plan view of target end 32 of playing surface 14 showing targets 34. There are 8–12 targets 34 in the preferred embodiment. Each target 34 preferably includes a slot 88 having walls 90 on each side of the slot. A coin 30 can impact the side of a wall 90 and still be directed down a slot 88. At the end of each slot 88, preferably positioned past the rear edge of playing surface 14, is an aperture 56. A rear wall 94 blocks any further motion of a coin towards the rear of game apparatus 10. In an alternate embodiment, the distance between adjacent walls 90 can be adjusted by the game operator to adjust the difficulty of guiding a coin into an aperture.

Each aperture 56 preferably includes a ramp 96. The ramp directs a coin that has fallen into the aperture towards a designated side of the aperture in the direction of arrow 98 to be sensed by a coin switch or other sensor positioned on the designated side in the aperture.

In an alternate embodiment, empty space can be provided between the rear end 87 of playing surface 14 and the apertures 56 so that a player may be required to jump coins over the empty space into the apertures (using small ramps, etc.) In other embodiments, playing surface can include additional apertures located in the middle or target end of the playing surface, or apertures of different sizes. Obstacles and confined routes can also be added to partially block some apertures or provide a smaller target to add difficulty to the game. Typically, the more difficult a target is to hit with a coin, the greater the point number added to the game score if the target is hit (game score is discussed subsequently). Some easy to hit targets can provide no score or a negative score. Also, playing surface 14 can be contoured, grooved, or have different textures in other embodiments.

FIG. 4*b* is a perspective view of target end 32 of a preferred embodiment of playing surface 14. Each slot 88 of target 34 is shown, as well as apertures 56 and ramps 96. A coin can be detected by sensor 58 positioned within each aperture 56, as shown.

Indicators 38 are used to highlight specific apertures to call attention to those apertures and/or display information about those apertures, and can include indicators 38*a* and 38*b*. Indicators 38*a* are positioned above corresponding apertures 56, while indicators 38*b* are positioned on playing surface 14 in front of each corresponding aperture 56. Either or both of indicators 38*a* and 38*b* can be provided in a particular embodiment. Preferably, indicators 38 include a transparent material and a standard light source positioned behind or underneath the transparent material which can be seen when the light source is illuminated. When a coin is detected by sensor 58 positioned in an aperture 56, the indicator 38*a* and/or 38*b* corresponding to the aperture into which the coin fell can be illuminated to indicate to the player which aperture 56 received a coin. This can be helpful to the player in determining which apertures received coins, since multiple coins may fall into different apertures 56 simultaneously.

When a coin falls into an aperture, the game score, as displayed by score display 36, is preferably adjusted by a specific amount. For example, each aperture 56 can be labelled with a point score that would be added to the game score of a coin fails into that aperture. Alternatively, specific apertures (e.g., apertures that are easy to direct a coin into) can cause the game score to decrease when a coin falls into them. Alternatively, the score can be adjusted by varying amounts for a specific aperture depending on how many coins have fallen into that aperture, how many activations the player has made, etc.

For example, in one embodiment, the player can be required to hit (send a coin into) or highlight successive targets in a row, from one side of the playing surface to receive a game score. For example, the number of successive targets from the left side to the right side of the playing field 14 that the player highlights determines the game score. If a player highlights the leftmost target and does not highlight the next targets to the right of the leftmost target, then a score of 2 (e.g., 2 tickets) is awarded. If the player highlights the leftmost four targets in a row but not the target after the fourth, then a score of 10 can be awarded, and so on. Preferably, indicators 38*a* (or 38*b*) can be used to highlight the targets so the player can see which successive targets were hit. This scoring pattern requires a player to direct multiple coins that have fallen out of coin directing mechanism 28 in a gradual line from left to right (or right-to-left in other embodiments). Preferably, if a player hits all the targets 34, then a progressive bonus award or "jackpot" is provided.

Other scoring variations are also possible. For example, a player can be required to illuminate as many targets in a row as possible, rather than successive targets from a side of the playing surface. Or, to receive a score, the player can be required to illuminating as many targets as possible, as few targets as possible, avoid "bankrupt" or negative score targets, turn off illuminated targets, or illuminate all targets with the fewest possible coins.

In another embodiment of the present invention, indicators 38*a* and/or 38*b* can be illuminated to highlight apertures before any coins have released by the player. This can indicate specific goals to the player, i.e., specific targets 34 are highlighted, and a player can aim coins toward the highlighted targets to increase the game score. For example, indicators 38*a* for apertures 56*a*, 56*b*, and 56*c* can be illuminated when a player starts a game. The player's goal might then be to direct one or more coins in all three of the highlighted apertures 56*a*, 56*b*, and 56*c* with one activation, i.e. multiple coins would be released with one press of activation button 26, and the player would have to direct them into the highlighted apertures. If a player has multiple activations available, different targets 34 can be highlighted for each activation. Alternatively, indicators 38*a* can be used to indicate for which apertures the player should aim, while indicators 38*b* can indicate the apertures into which coins have fallen (or vice-versa).

Certain indicators 38*a* or 38*b* can also be illuminated to indicate a progressive goal to the player; for example, all the apertures could be highlighted. A player who managed to direct at least one coin into all of the apertures with one activation would achieve the progressive goal, and a progressive bonus score displayed by score display 39 would be added to the normal game score displayed by score display 36. Or, a specific pattern of timed illuminations might highlight some apertures for a few seconds, "unhighlight" those apertures, then highlight other apertures to increase the difficulty of the game, i.e., the player would have to aim coins for targets only when they are highlighted. In, addition, other combinations of indicators, 38*a* and/or 38*b* can be illuminated to designate a collective progressive goal, which, if achieved by the player, would cause a collective progressive bonus score stored by a separate bonus apparatus (not shown) to be added to the game score. In alternate embodiments, a fixed, predetermined "jackpot" score can be providing to the player for achieving goal similar to a progressive goal.

Other types of indicators 38*a* and 38*b* can be provided in alternate embodiments. For example, an LED or LCD digit display over each aperture 56 can indicate a number of coins that should be received by each apertures for the player to receive a game score or a progressive bonus score. These numbers can be adjusted by the game control system during game play to reflect current game conditions.

Figure 4C:
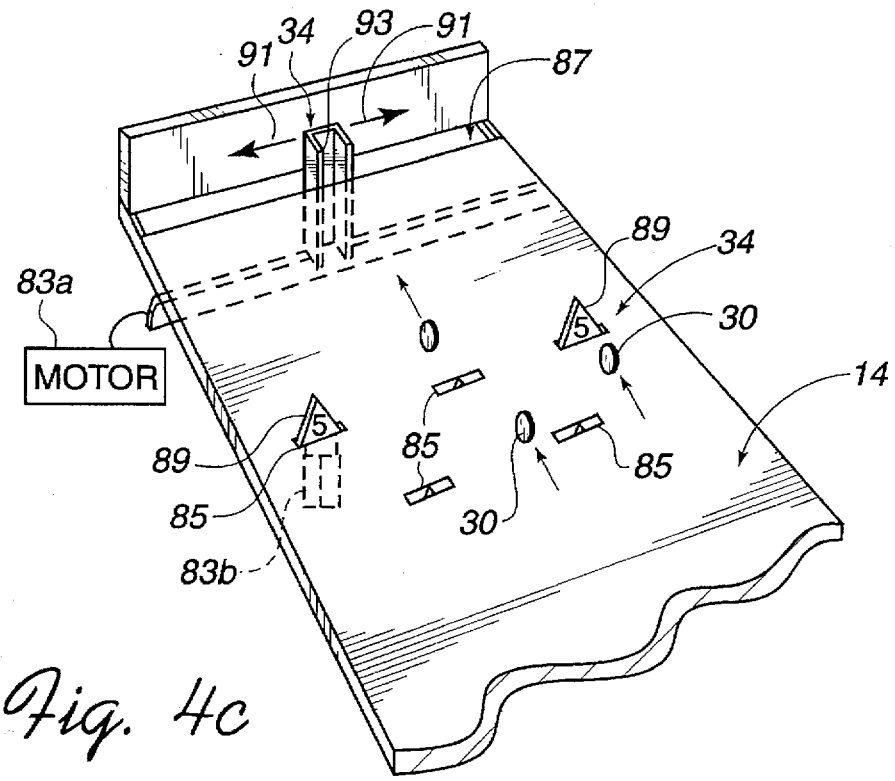
FIG. 4*c* is a perspective view of the target end of an alternate embodiment of the playing surface.

FIG. 4*c* is a perspective view of target end 32 of an alternate embodiment of playing surface 14 and targets 34. In this embodiment, targets 34 can be "pop-up" targets 89. Pop-up targets 89 can be positioned in slots 85 in the playing surface 14. The targets 89 can be designed to raise or "pop-up" in a slot 85 at selected or random intervals. For example, one row of pop-up targets can be selected to raise up and remain in a raised position while an adjacent row of targets 89 are lowered. Preferably, if a coin 30 or other playing piece engages or impacts a target 89, a score number is added to the game score. This score number can be indicated on the pop-up target 89 itself, as shown in FIG. 4*c*.

A moving target 93 is also shown in FIG. 4*c* that can be used solely or in conjunction with other types of targets 34. Target 93 is positioned adjacent to the rear edge 87 of playing surface 14 and preferably moves from left to right and then from right to left along rear edge 87, as indicated by arrows 91. As the target 93 moves along edge 87, the player can try to aim and hit the target 93 with multiple coins that roll down playing surface 14. Coins that are received by target 93 are preferably routed to the collection ramp 60. In other embodiments, multiple moving targets 93 can be provided; or, targets 93 can be moved in other directions, such as up and down. Targets 89 and 93 can be moved with a motor 83*a*, solenoid 83*b*, and/or other mechanisms well known to those skilled in the art. The width of target 93 can also be adjustable by the game operator to adjust the difficulty of the game.

Figure 4D:
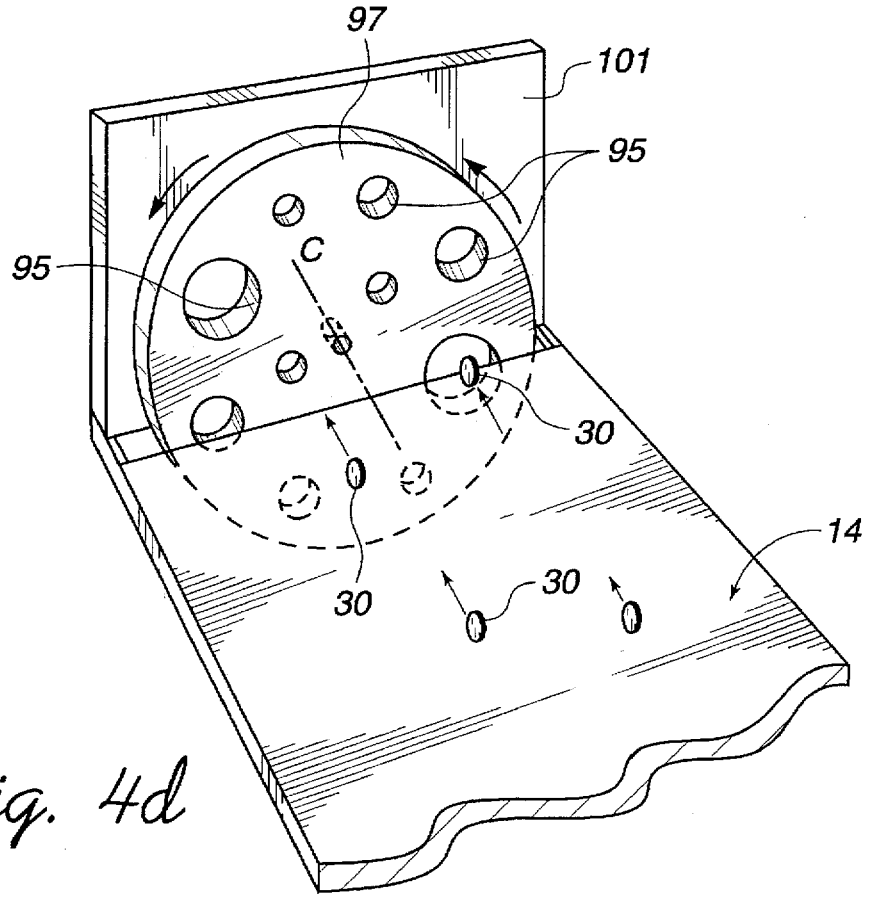
FIG. 4*d* is a perspective view of the target end of another alternate embodiment of the playing surface.

FIG. 4*d* is a perspective view of target end 32 of another alternate embodiment of playing surface 14 and targets 34. In this embodiment, apertures 95 are provided in a rotating wheel 97. Wheel 97 can be coupled to a rear wall 101 by a shaft parallel to axis C and be caused to rotate about axis C by a motor or similar mechanism in a clockwise or counterclockwise direction. As apertures 95 rotate close to playing surface 14, coins 30 may roll through the apertures and fall onto collection ramp 60 below. Sensors (not shown) similar to those described above can be provided in apertures 95 to detect which aperture a coin fell through, and an appropriate score can be added to the game score (the score can be labelled at each aperture in some embodiments). The score associated with an aperture can be dependent, for example, on the size of the aperture, where a small aperture has contributes a high score and a large aperture contributes a small score. Wheel 97 can also be rotated at different speeds or changing speeds or directions to alter the difficulty of the game.

Figure 5:
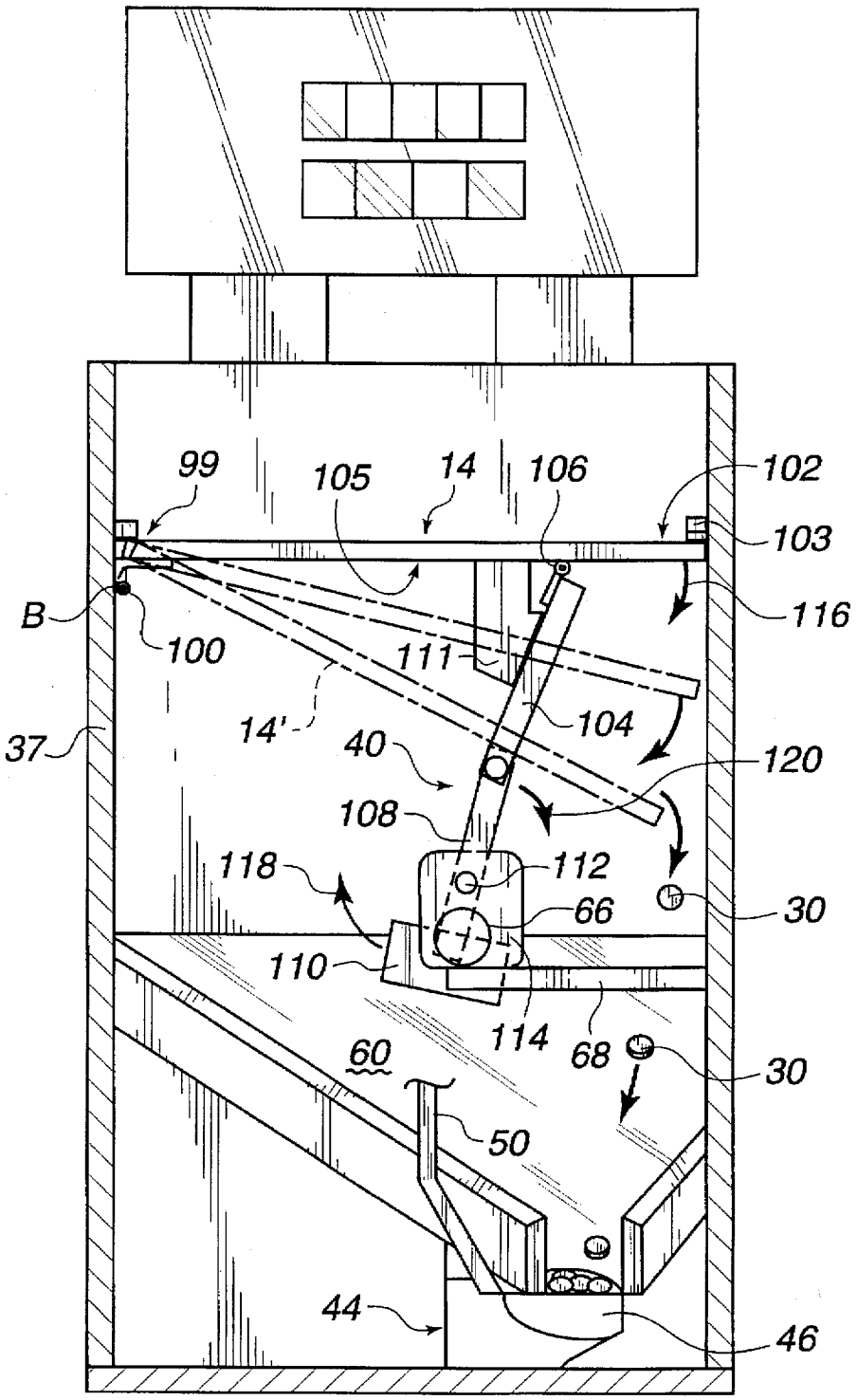
FIG. 5 is a elevational front view of the game apparatus taken along line 5—5 of FIG. 1.

FIG. 5 is a front sectional view of game apparatus 10 taken along line 5—5 of FIG. 1. Playing surface 14 is attached to game cabinet 37 on one side 99 by one or more hinges 100. The opposite side 102 of the playing surface 14 is not coupled to game cabinet 37, but is supported by tilting mechanism 40. A stop 103 is provided to prevent side 102 of playing surface 14 from moving up beyond a desired level.

The bottom side 105 of playing surface 14 is coupled to a first end of a support arm 104 of tilting mechanism 40 by a hinge 106. The second end of support arm 104 is rotatably coupled to a first end of a cam arm 108 of tilting mechanism 40. A cam weight 110 is coupled to the second end of cam arm 108. The center of cam arm 108 is also coupled to a drive shaft 112 that is driven by motor 66. Motor 66 and a shaft support 114 are supported by platform 68 coupled to game cabinet 37.

Tilting mechanism 40 is operative to lower end 102 of playing surface 14 and thus rotate playing surface 14 about axis B in a direction indicated by arrow 116. Motor 66 is activated by the control system to rotate shaft 112. Shaft 112 is coupled to the drive shaft of motor 66 preferably by a gear assembly within shaft support 114. The rotation of shaft 112 causes the cam end of cam arm 108 to rotate in the direction indicated by arrow 118. This causes the opposite end of cam arm 108 to rotate in the direction indicated by arrow 1202. This motion, in turn, causes support arm 104 to lower, which causes end 102 of playing surface 14 to also lower and rotate about axis B. This motion is more clearly shown in FIGS. 6*a*–6*c*. The playing surface is lowered until it reaches a final lowered position shown by dashed lines 14' that is sufficient to allow coins 30 to slide off the playing surface. In alternate embodiments, other mechanisms can be used to clear the playing surface; for example, a mechanism for vibrating the playing surface can be used to vibrate the coins off the sides of the playing surface.

FIG. 5 also shows collection ramp 60. Coins 30 that have come to rest on playing surface 14 slide or roll off playing surface 14 when tilting mechanism 40 tilts the playing surface to the final lowered position. The coins fall onto ramp 60 and into collection bin 46 of coin hopper 44.

Figure 6A:
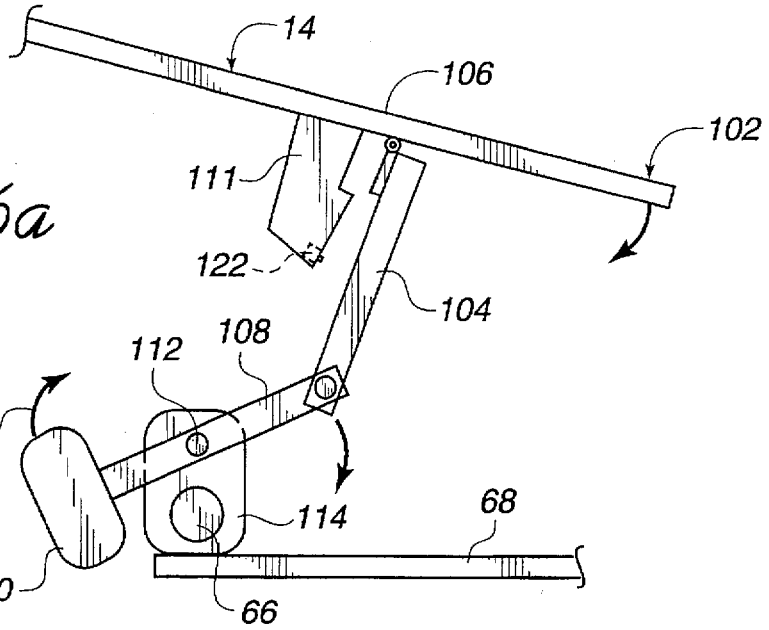
FIGS. 6*a*—6*c* are detailed views of the tilting mechanism of the present invention at various stages in the process of tilting the playing surface.
Figure 6B:
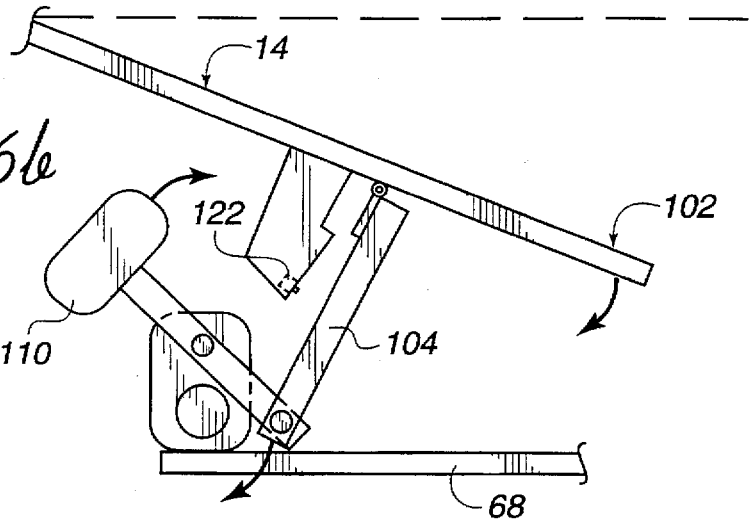
Figure 6C:
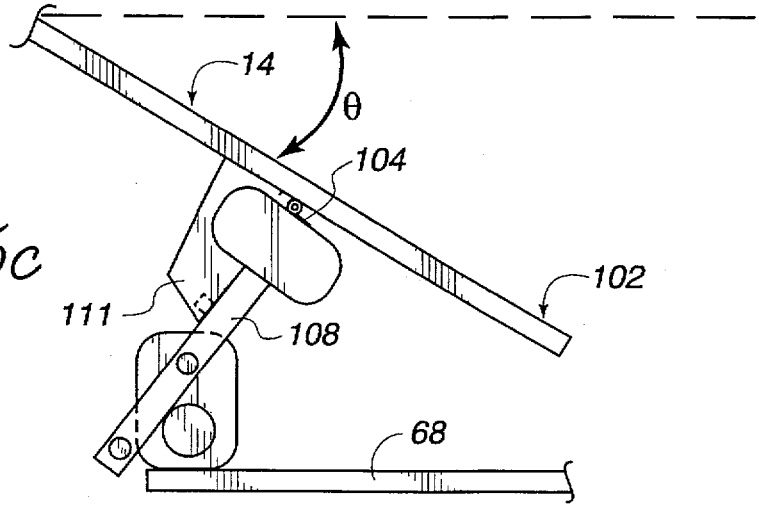

FIGS. 6*a*–6*c* illustrate how the described tilting mechanism 40 tilts playing surface 14. In FIG. 6*a*, cam arm 108 has been rotated in the direction of arrow 118 to cause support arm 104 to lower. End 102 of playing surface 14 corresponding lowers as support arm 104 lowers. Cam weight 110 is used to balance the weight of support arm 104 and playing surface 14 so that motor 66 can rotate cam arm 108 without undue strain.

An arm stop 111 is preferably coupled to playing surface 14 to prevent any movement of support arm 104 after playing surface 14 has been moved to a level position (as shown in FIG. 5) or to a final lowered position (shown in FIG. 6*c*). A tilt sensor 122 is preferably coupled to arm stop 111 to detect when playing surface 14 is in the level position and in the final lowered position. Tilt sensor 122 is preferably a micro switch or similar contact sensor that senses when support arm 104 contacts the switch. Sensor 122 can be other types of sensors in other embodiments.

FIG. 6*b* shows an intermediate position of playing surface 14, cam arm 108, and support arm 104. FIG. 6*c* shows the final lowered position of arms 108 and 104 and playing surface 14. At the final lowered position, playing surface 14 has been rotated θ degrees from its level position, where θ is an angle sufficient for all playing pieces to slide off the playing surface. For example, θ can be about 25 degrees. When cam arm 104 has been rotated to the position shown in FIG. 6*c*, support arm 104 is rotated back to its original position against stop 111, and thus support arm 104 contacts tilt sensor 122 to activate the sensor 122. The activation of the sensor 122 informs the control system that playing surface 14 is in the final lowered position and that the motor 66 should thus be deactivated. After a predetermined length of time, such as a few seconds, the control system controls motor 66 to rotate its shaft in the opposite direction, thus causing playing surface 14 to elevate to the original level position. Sensor 122 detects when the playing surface is at this level position when support arm 104 is raised to the position shown in FIG. 5, where it contacts sensor 122 to inform the control system to again deactivate the motor. In other embodiments, different mechanisms can be used to tilt playing surface 14.

Figure 7:
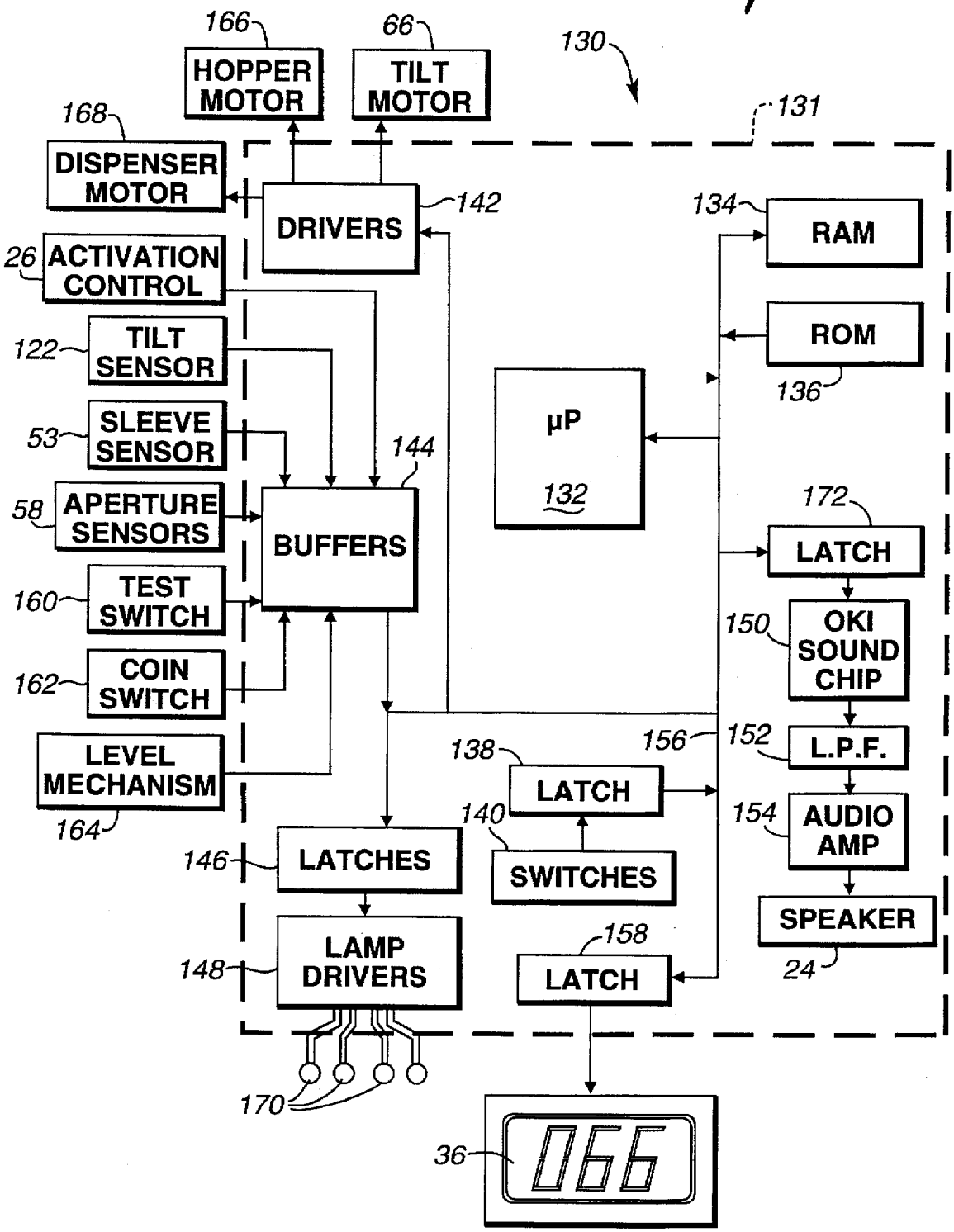
FIG. 7 is a block diagram of an electronic control system of the game apparatus.

FIG. 7 is a block diagram of a control system 130 of game apparatus 10. The control system, for example, can be implemented on one or more printed circuit boards 131 which can be located in the interior of game apparatus 10, for example, on a side in the interior of the game apparatus. The components of control system 130 include a microprocessor 132, random access memory (RAM) 134, read-only memory (ROM) 136, a latch 138, DIP switches 140, a game score display 36, drivers 142, buffers 144, latches 146, lamp drivers 148, sound chip 150, low pass filter 152, audio amplifier 154, and speaker 24.

Microprocessor 132 controls the operations of game apparatus 10. A suitable microprocessor is an 8-bit microprocessor, such as the Intel 8031, which has the range of features adequate for the task, including eight data lines and sixteen address lines. The microprocessor preferably executes software instructions that can be stored in memory, as explained below. Microprocessor 132 is coupled to ROM 136 by a data/address/control bus 156. The ROM 136 is preferably an erasable, programmable read-only memory (EPROM) that contains the start-up instructions and operating system for the microprocessor 132. Microprocessor 132 is connected to RAM 134 by bus 156 to permit the use of RAM for scratch-pad memory. Methods for coupling ROM 136 and RAM 134 to the microprocessor 132 by bus 156 including enable, address, and control lines are well-known to those skilled in the art.

The microprocessor 132 is also coupled to a latch 138 by the bus 156. The switches 140 coupled to latch 138 provide selectable game functions that the operator of the game unit may change to his or her liking. These selectable functions can include the amount the score is incremented when a coin falls into a particular aperture 56, the amount of tickets dispensed based on the score, the speed of release of coins 30 from coin directing mechanism (i.e., the amount of delay between the release of each coin in an activation), the number of activations a player receives for one coin inserted in coin slot 18, the conditions required to add to the game score and/or receive an award, the conditions required for a player to win a progressive bonus, etc. These factors can affect the difficulty of the game and the amount of awards received by players. Other functions selectable by switches 140 can include sound effects, the test mode, the type of game, and so on, depending on how many selectable functions are desired. Switches 140 can, for example, be implemented as DIP switches. Alternatively, the functions selected by switches 140 can be selected from another input device, such as a control panel or keyboard of buttons, or through software commands to the microprocessor 132.

Microprocessor 132 is also coupled to score display 36. The bus 156 connecting the microprocessor 132 to the score display 36 is latched by a latch 158. The score display can be a 7-segment LED digit display or similar display.

Microprocessor 132 is also coupled to drivers 142 and buffers 144. Buffers 144 receive data from several switches and sensors, including test switch 160, coin slot switch 162, level mechanism 164, aperture sensors 58, sleeve sensor 53, and tilt sensor 122. Test switch 160 can be a switch located in the interior of game apparatus 10 accessible to the operator which activates a test mode for the game apparatus 10 to determine if the game is operating correctly. Coin slot switch 162 detects when a coin has been inserted into coin slot 18 of the game apparatus. Level mechanism 164 can detect when the entire game apparatus 10 has been moved or tilted past a designated level so that microprocessor 132 can stop a game when such movement is detected. Aperture sensors 58 detect any coins 30 that have fallen into apertures 56. Sleeve sensor 58 detects the number of coins released from coin directing mechanism 28, and tilt sensor 122 detects when playing field 14 has been tilted to the final lowered position as shown in FIG. 6*c*. Activation control 26 causes a number of coins 30 to be released from coin directing mechanism 28.

Drivers 142 activate and drive output devices including hopper motor 166 for dispensing coins from coin hopper 44, tilt motor 66 of tilting mechanism 40 for tilting playing surface 14, and dispenser motor 168 for dispensing an award from award dispenser 22.

The microprocessor 132 is also coupled to latches 146 which latch data for the lamp drivers 148. The lamp drivers 148 supply power to the lamps 170, which include, for example, light sources for illuminating indicators 38 when a coin fails into an aperture 56 or to indicate to the player which apertures should receive coins to modify game score. Lamps 170 can also include additional lamps provided on or around the perimeter of front panel 12, playing field 14, and other similar areas of game apparatus 10 which can be highlighted as part of game action. In the preferred embodiment, components such as the motors 66, 166 and 168 and lamps 170 are powered by a commercially available 110 V AC power supply and power converters, which are well known in the art. The microprocessor 132 is also coupled to a sound chip 150 which can be, for example, an OKI Voice Synthesis LSI chip available from OKI Semiconductor of San Jose, Calif. that has eight data input lines coupled to the microprocessor 132 by a latch 172. The sound chip 1S0 can receive its data from ROMs (not shown) and preferably outputs sound data to a low pass filter 152, an audio power amplifier 154, and finally to the output speaker (s) 24, which generate sounds to the player playing the game apparatus 10, as is well known to those skilled in the art.

The preferred embodiment of the control system 130 operates briefly as follows. The microprocessor 132 first reads the low memory from ROM 136 over bus 156 and sequences through the software instructions stored in ROM. The settings of switches in the switches block 140 are also read into the microprocessor. The software from the ROM 136 then instructs the microprocessor 132 to send and receive data over the bus 156 in order to wait for a game to begin and to conduct a game. For example, when the coin slot switch 162 is activated, indicating a coin has been inserted into coin slot 18, the microprocessor receives a signal from buffers 144 on bus 156. The microprocessor also receives signals when activation control 26 is activated by the player. The microprocessor sends signals to the drivers 142 over bus 156 to control hopper motor 166 to dispense coins and reads sleeve sensor 53 through buffers 144 to determine when to deactivate the hopper motor. The microprocessor reads information from aperture sensors 58 and 74 through buffers 144 to determine which targets 34 have received coins. During game play, the microprocessor sends appropriate output signals over bus 156 to update game score display 36 and activate speaker 24 and lamps 170. Once the game is over, the microprocessor activates dispenser motor 168 and tilt motor 66 through drivers 142 and reads tilt sensor 122 through buffers 144. The method of operation of the preferred embodiment of the game apparatus is described in greater detail with respect to FIG. 8.

Figure 8:
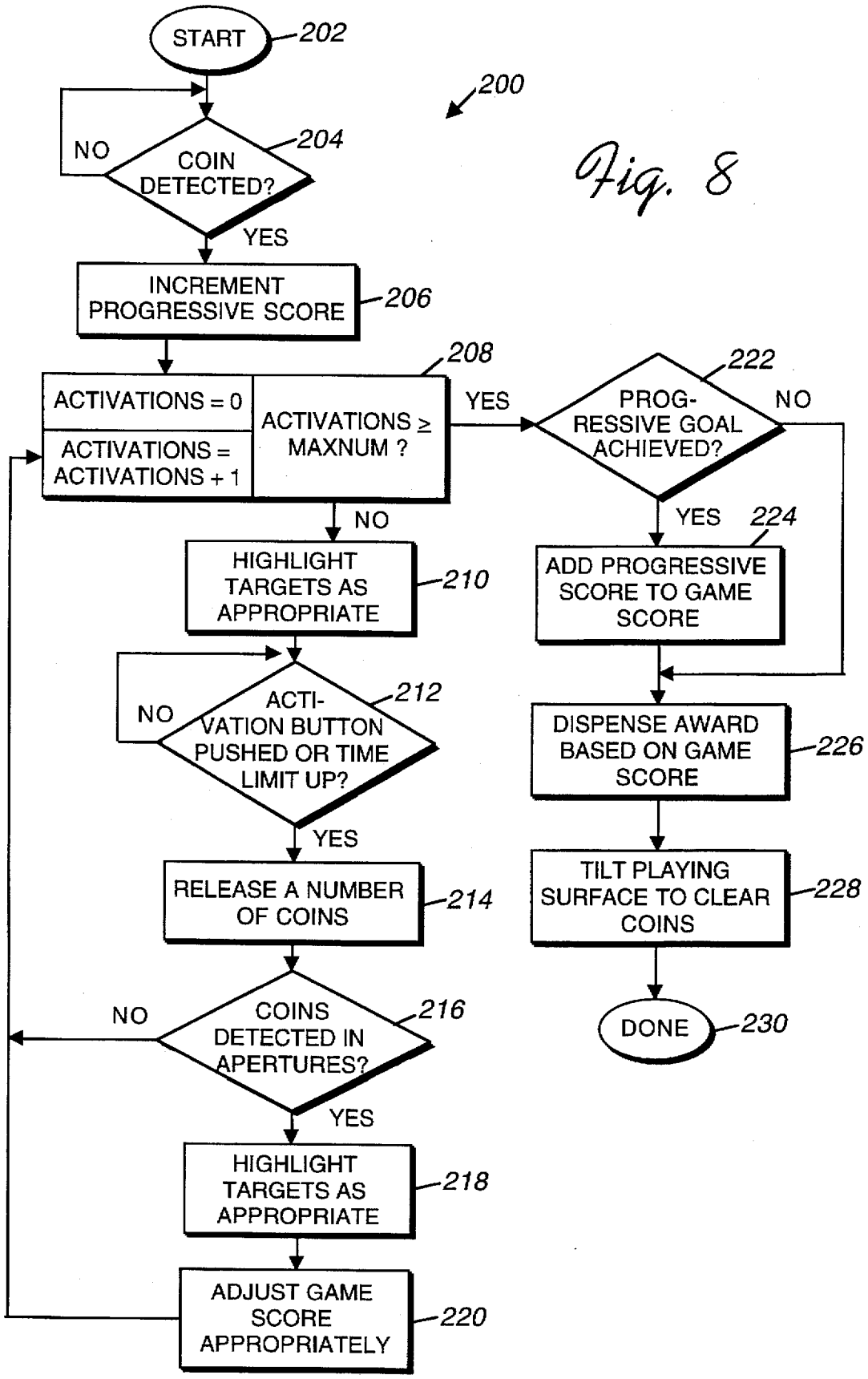
FIG. 8 is a flow diagram illustrating a method of playing and operating the game apparatus of FIG. 1.

FIG. 8 is a flow diagram illustrating a method 200 of operating and playing the described embodiment of game apparatus 10. The process begins at 202. In step 204, the microprocessor checks if a coin has been inserted into coin slot 18 by checking a signal from coin slot switch 162. If no coin is detected, step 204 is repeated until a coin is detected. In step 206, the progressive score is incremented and displayed on score display 39 if a progressive score is being implemented. If a multi-game system with a progressive bonus apparatus is being used, the microprocessor of the game apparatus can send a signal to the progressive bonus apparatus to increment a collective progressive score and receive an updated progressive score signal from the bonus apparatus. The microprocessor can receive an updated progressive score signal from a connected bonus apparatus, any time during process 200 or even when a game is not being played, since players on other game apparatuses connected to the bonus apparatus can contribute to the collective progressive score at any time.

In step 208, the variable ACTIVATIONS is initialized to zero and the microprocessor checks if ACTIVATIONS is greater than or equal to MAXNUM, which is the number of separate "activations" that a player receives per game, e.g., with the insertion of one coin in coin slot 18. This number can be set by the operator of game apparatus 10. As described above, an "activation" is one activation of activation button 26 by a player, which causes a number of coins to be released from coin directing mechanism 28. In the preferred embodiment, MAXNUM=1 so that the player only gets one activation per game. At this, time, all indicators 38 can be deactivated if any are illuminated from a previous game.

If ACTIVATIONS is less than MAXNUM, then in step 210, the microprocessor highlights targets as appropriate to the embodiment. For example, indicators **38*b* can be illuminated to highlight specific apertures 56 as scoring apertures which will increase the game score if a coin is received by those apertures. Or, a progressive goal can be similarly designated at this time. Alternatively, no targets 34** need be highlighted in this step.

In next step 212, the microprocessor checks if the activation button 26 has been pressed by the player or if a predetermined time limit since the coin was inserted in coin slot 18 has expired. If neither of these conditions is true, then the microprocessor continues to check for these conditions in step 210. Optionally, the microprocessor can automatically end the game if the player does not push the activation button 26 within a predetermined time limit after inserting a coin. If either of these conditions is true, then step 214 is implemented, in which a number of coins are released or ejected from coin directing mechanism 28 onto playing surface 14. Hopper motor 166 is activated by the microprocessor to dispense a number of coins, and sleeve sensor 53 is read to determine how many coins have been released so that the hopper motor can be deactivated at the appropriate time. The number of released coins is designated by the operator of the game apparatus. The coins then roll toward targets 34 on target end 32 of playing surface 14.

In step 216, the microprocessor checks if any coins have been detected in apertures 56 by coin sensors 58. Preferably, the microprocessor waits a predetermined length of time after the last coin is released from mechanism 28, such as S seconds. All coins are assumed to have either already fallen into an aperture or come to rest on playing surface 14 after this time period has expired. If no coins have been detected in apertures 56 (an unlikely occurrence), then the process returns to step 208 to increment the number of activations. If coins have been detected, then in step 218, targets 34 are highlighted of appropriate. For example, those apertures that have received coins can be highlighted immediately when the coin is detected by sensor 58 in the aperture by illuminating indicators **38*a* or 38*b***. The aperture can be highlighted for a few seconds after the coin is detected, and then turned off; or, the aperture can stay highlighted until all coins have fallen into apertures, or until a game is over.

In next step 220, a game score is adjusted based upon the scores of apertures 56 which received coins 30 and is displayed on score display 36. Specific apertures can cause the game score to increase, decrease, or remain the same, as described above with reference to FIGS. **4*b*–4*d***. The amount of score adjustment can be displayed as a number near each aperture, or be a constant or random amount.

The pattern or number of targets receiving coins determine a resulting game score depending on the scoring particulars of the embodiment. If this is the player's second or later activation (i.e., the variable ACTIVATIONS=1 or greater), then the game score from the current activation is can be added to the total game score value that has been accumulated from previous activations. Other variations are also possible to achieve game score; for example, the best game score from any activation can be used as a final game score, or aperture scores can be multiplied, subtracted, etc.

In an alternate embodiment, indicators 38*a* and/or 38*b* can be shown as symbols, and a game score can be based upon a combination of symbols whose apertures have received coins. For example, indicators 38*a* and 38*b* can display playing card symbols, each symbol indicating a card number and suit. A player can try to illuminate a specific card hand according to the rules of poker, blackjack, etc.

After calculating and displaying a game score in step 220, the process returns to step 208, where the microprocessor increments ACTIVATIONS and again checks if ACTIVATIONS is greater than or equal to MAXNUM. When this is true, step 222 is implemented, in which the microprocessor checks if a progressive goal was achieved by the player during the game. A progressive goal may be achieved, for example, when the player aims a coin into designated apertures 56, aims a coin into a specific target over several activations, etc. In addition, different goals can be designated for an individual progressive bonus and for a collective progressive bonus.

If the progressive goal was not achieved by the player, the process continues to step 226, detailed below. If a progressive goal was achieved by a player of game apparatus 10, then the accumulated progressive score displayed on score display 39 is added to the game score in step 224 to result in a new game score. When using a separate progressive bonus apparatus, the microprocessor can send a signal to the progressive bonus apparatus which indicates that the progressive goal has been achieved and includes the identity of the winning individual game apparatus 10. The progressive score would then be received by the winning game apparatus from the progressive bonus apparatus and added to the game score of the individual game apparatus 10.

Alternatively, steps 222 and 224 can be implemented after step 220 for each activation of the game apparatus. In such an embodiment, the player could receive a progressive bonus score for each activation.

In next step ,226, an award based on the game score (as modified by step 224) is dispensed to the player from award dispenser 22. For example, one award ticket can be dispensed for each point of game score. Alternatively, one award ticket can be dispensed for every X scored points; for example, X=10. Alternatively, an operator of the game apparatus can manually provide an award to the winning player based upon the game score. In next step 228, the microprocessor causes playing surface 14 to tilt using tilt motor 66 so that any coins remaining on the playing surface will fall down into collection bin 46 of coin hopper 44. The microprocessor then causes the playing surface to elevate back to its original level so that the game apparatus will be ready for the next game. The game process is then complete as indicated at 230. The process can also return to step 202 to wait for another coin to be inserted in coin slot 18.

In other embodiments, an award from dispenser 22 can be dispensed at different times during the game process 200. For example, an award based on the game score can be dispensed to the player after each activation or after all activations, and then an award based on the progressive score can be dispensed or manually provided by an operator of the game apparatus. In those embodiments which do not include a progressive score or a progressive bonus apparatus, steps 222 and 224 can be omitted.

While this invention has been described in terms of several preferred embodiments, it is contemplated that alterations, modifications and permutations thereof will become apparent to those skilled in the art upon a reading of the specification and study of the drawings It is therefore intended that the following claims include all such alterations, modifications and permutations as fall within the spirit and scope of the present invention.

What is claimed is:

1. A game apparatus comprising:

a playing surface;

a playing piece guiding mechanism positioned at a player end of said playing surface and movable by a player of said game apparatus for directing playing pieces across said playing surface in a direction determined by said player;

an activation control, wherein when said activation control is activated once, a plurality of playing pieces are released onto said playing surface through said playing piece guiding mechanism; and a target positioned near a target end of said playing surface for receiving at least one of said released playing pieces.

2. A game apparatus as recited in claim 1 wherein said playing surface is inclined.

3. A game apparatus as recited in claim 2 wherein said plurality of playing pieces are a plurality of coins, wherein said coins are operative to roll down said inclined playing surface such that a predetermined number of said coins are released in rapid succession onto said playing surface after each of said activations of said activation control.

4. A game apparatus as recited in claim 2 wherein said playing piece guiding mechanism can be pivoted by said player to direct said playing pieces in a desired direction.

5. A game apparatus as recited in claim 4 wherein said activation control includes a button that can be pressed to release said plurality of playing pieces.

6. A game apparatus as recited in claim 2 further comprising a digital controller operative to control operations of said game apparatus.

7. A game apparatus as recited in claim 6 wherein said activation control is activated by said digital controller.

8. A game apparatus as recited in claim 1 wherein said activation control is activated by said player.

9. A game apparatus as recited in claim 1 further comprising a mechanism for moving said target, wherein said movement of said target is approximately constrained along a target end of said playing surface.

10. A game apparatus as recited in claim 1 wherein said target is one of a plurality of targets positioned at said target end, each of said targets including an aperture into which said playing piece may fall.

11. A game apparatus as recited in claim 10 wherein at least one of said targets includes a sensor for detecting when a playing piece has fallen into said aperture associated with said at least one target.

12. A game apparatus as recited in claim 11 wherein said targets each include a slot including guide walls to guide said playing pieces to said apertures.

13. A game apparatus as recited in claim 10 further comprising a tilting mechanism for tilting said playing surface after a game is over to clear said playing surface of said playing pieces that have not fallen into said apertures.

14. A game apparatus as recited in claim 10 further comprising a highlighter for highlighting designated ones of said targets.

15. A game apparatus as recited in claim 1 further comprising a mechanism for moving said playing pieces from a collection area to said playing piece guiding mechanism, said mechanism for moving being coupled to said activation control.

16. A game apparatus as recited in claim 1 further comprising a scoring apparatus for accumulating a game score and a progressive score, said progressive score being accumulated over a plurality of games played on said game apparatus.

17. A game apparatus as recited in claim 1 wherein said playing pieces are substantially spherical.

18. A roll-down game apparatus comprising:

a playing surface;

a coin directing mechanism positioned at a player end of said playing surface, said coin directing mechanism being movable by said player for directing coins across said playing surface in a direction desired by a player of said roll-down game apparatus;

an activation control, wherein when said activation control is activated once, a plurality of coins are released onto said playing surface from said coin directing mechanism;

a coin moving apparatus coupled to said activation control for forcing said plurality of coins through said coin guiding mechanism and onto said playing surface when said activation control is activated; and a target positioned near a target end of said playing surface for receiving said released plurality of coins.

19. A roll-down game apparatus as recited in claim 18 wherein said playing surface is inclined and allows said plurality of coins to roll down said inclined playing surface.

20. A roll-down game apparatus as recited in claim 18 wherein said coin directing mechanism can be pivoted by said player to direct said coins in a desired direction across said playing surface.

21. A roll-down game apparatus as recited in claim 18 further comprising a plurality of targets positioned near said target end of said playing surface, each of said targets including an aperture into which said coins may fall, each of said apertures including a sensor for detecting when a coin has fallen into said aperture.

22. A roll-down game apparatus as recited in claim 21 further comprising a plurality of indicators, each of said indicators being associated with one of said apertures and being operative to highlight said associated aperture.

23. A roll-down game apparatus as recited in claim 22 wherein said indicators each includes a light source to illuminate said indicator.

24. A roll-down game apparatus as recited in claim 23 wherein when said sensor detects a coin in one of said apertures, said indicator associated with said aperture is illuminated to highlight said aperture.

25. A roll-down game apparatus as recited in claim 24 wherein said indicators are illuminated to highlight designated ones of said apertures to indicate that only said designated ones of said apertures increase said game score when receiving a coin.

26. A roll-down game apparatus as recited in claim 25 further comprising a mechanism for providing a progressive bonus score to said player when said player achieves a progressive goal, said progressive goal being communicated to said player by said indicators.

27. A roll-down game apparatus as recited in claim 25 further comprising a tilting mechanism coupled to said controller for tilting said playing surface after a game is over to clear said playing surface of said coins that have not fallen into said apertures.

28. A roll-down game apparatus as recited in claim 21 further comprising a scorer coupled to said sensors and operative to change a game score after said sensors detect said at least one of said plurality of coins.

29. A roll-down game apparatus as recited in claim 21 wherein said coin moving apparatus is a coin hopper for moving said playing pieces from a collection area at a bottom area of said game apparatus to said coin directing mechanism located at a higher elevation than said coin hopper.

30. A roll-down game apparatus as recited in claim 21 further comprising a coin slot coupled to a coin storage box, such that when a coin is inserted in said coin slot, a game on said game apparatus is started and said inserted coin is routed to said coin storage box, said inserted coin being stored separately from said plurality of coins released onto said playing surface.

31. A game apparatus comprising:

a playing surface;

a playing piece guiding mechanism positioned at a player end of said playing surface for directing playing pieces down said playing surface in a desired direction;

an activation control, wherein when said activation control is activated once, a plurality of playing pieces are released onto said playing surface;

a target positioned near a target end of said playing surface for receiving at least one of said released playing pieces; and a mechanism for moving said target.

32. A game apparatus as recited in claim 31 wherein said target includes an aperture in a wheel, and wherein said mechanism for moving said target includes a mechanism for rotating said wheel about an axis approximately parallel to said playing surface.

33. A game apparatus comprising:

a playing surface;

a playing piece guiding mechanism positioned at a player end of said playing surface for directing playing pieces across said playing surface in a desired direction;

an activation control, wherein when said activation control is activated once, a plurality of playing pieces are released onto said playing surface;

a target positioned near a target end of said playing surface for receiving at least one of said released playing pieces; and a tilting mechanism for tilting said playing surface after a game is over to clear said playing surface of said playing pieces that are resting on said playing surface when said game is over.

34. A game apparatus as recited in claim 33 wherein said tilting mechanism includes a support arm and a cam arm, said support arm being coupled to said playing surface, said cam arm being coupled to said support arm and operative to rotate to lower said support arm and thereby lower a side of said playing surface.

35. A roll-down game apparatus comprising:

a playing surface;

a coin directing mechanism positioned at a player end of said playing surface for directing coins across said playing surface in a desired direction;

an activation control, wherein when said activation control is activated once, a plurality of coins are released onto said playing surface from said coin directing mechanism;

a coin moving apparatus coupled to said activation control for forcing said plurality of coins through said coin guiding mechanism and onto said playing surface when said activation control is activated, wherein said apparatus for moving said coins is a coin hopper for moving said playing pieces from a collection area at a bottom area of said game apparatus to said coin directing mechanism located at a higher elevation than said coin hopper; and a plurality of targets positioned near a target end of said playing surface for receiving said released plurality of coins, each of said targets including an aperture into which said playing piece may fall.

36. A roll-down game apparatus comprising:

a playing surface;

a coin directing mechanism positioned at a player end of said playing surface for directing coins across said playing surface in a desired direction;

an activation control, wherein when said activation control is activated once, a plurality of coins are released onto said playing surface from said coin directing mechanism;

a coin moving apparatus coupled to said activation control for forcing said plurality of coins through said coin directing mechanism and onto said playing surface when said activation control is activated;

a target positioned near a target end of said playing surface for receiving said released plurality of coins; and a coin dot coupled to a coin storage box, such that when a coin is inserted in said coin slot by a player, a game on said game apparatus is started and said inserted coin is routed to said coin storage box, said inserted coin being stored separately from said plurality of coins released onto said playing surface.

37. A method for playing a roll-down game apparatus comprising:

determining when an activation control has been activated by a player of said roll-down game apparatus;

dispensing a plurality of playing pieces onto a playing surface such that each of said playing pieces rolls down said playing surface from a dispenser in a direction chosen by said player, said direction not being chosen solely by adjusting a force urging said playing pieces from said dispenser, said dispensing being performed after said activation control has been activated and for each such activation;

providing a plurality of targets on said playing surface, said targets being able to engage said playing pieces; and providing a game score based on said targets that receive said playing pieces.

38. A method as recited in claim 37 wherein said playing pieces are coins.

39. A method as recited in claim 38 wherein said targets include apertures provided at one end of said playing surface.

40. A method as recited in claim 39 wherein said player directs said playing pieces using a guiding mechanism that allows said player to guide said coins toward said targets.

41. A method as recited in claim 40 further comprising highlighting said apertures that receive said coins.

42. A method as recited in claim 41 wherein said game score is based on a predetermined pattern of said apertures which receive said coins, such that said apertures are provided in an adjacent line at a target end of said playing surface, wherein said game score is based on an adjacent number of said apertures which have received said coins.

43. A method as recited in claim 38 further comprising highlighting designated ones of said targets.

44. A method as recited in claim 43 wherein said targets are highlighted before said dispensing said coins, wherein only said designated targets cause said game score to increase when engaging said coins.

45. A method as recited in claim 38 wherein said targets include apertures into which said coins may fall, and wherein said game score is determined by detecting coins in said apertures and adjusting said game score based on apertures that receive said coins.

46. A method as recited in claim 45 further comprising contributing to a progressive score and adding said progressive score to said game score when said player achieves a progressive goal.

47. A method for playing a roll-down game apparatus comprising:

determining when an activation control has been activated by a player of said roll-down game apparatus;

dispensing a plurality of coins onto a playing surface such that said coins roll down said playing surface, said dispensing of said plurality of coins being performed after said activation control has been activated and for each such activation;

providing a plurality of targets on said playing surface, said targets being able to engage said coins, wherein said targets include apertures in said playing surface;

providing a guiding mechanism allowing a player to guide said coin toward said targets;

highlighting said apertures that receive said coins; and providing a game score based on said targets that receive said coins, wherein said game score is based on a predetermined pattern of said apertures which receive said coins.

48. A method as recited in claim 47 wherein said apertures are provided in an adjacent linear configuration at a target end of said playing surface, and wherein said game score is based on an adjacent number of said apertures which have received said coins.

49. A method for playing a roll-down game apparatus comprising:

determining when an activation control has been activated by a player of said roll-down game apparatus;

dispensing a plurality of coins onto a playing surface such that said coins roll down said playing surface, said dispensing of said plurality of coins being performed after said activation control has been activated and for each such activation;

providing a plurality of targets on said playing surface, said targets being able to engage said coins;

providing a game score based on said targets that receive said coins; and tilting said playing surface after providing said game score, said tilting being operative to clear coins resting on said playing surface that have not been received by said targets.

* * * * *